US005741035A

United States Patent [19]

Glass

[11] Patent Number: 5,741,035

[45] Date of Patent: Apr. 21, 1998

[54] DEVICE TO ASSIST IN PUTTING ON FLEXIBLE BRACELETS AND NECKLACES

[76] Inventor: Leo Glass, 20 Hammond St., Monticello, N.Y. 12701

[21] Appl. No.: 716,994

[22] Filed: Sep. 20, 1996

[51] Int. Cl.[6] ..... A44B 21/00; B25B 27/00

[52] U.S. Cl. ..... 294/1.1; 24/3.11; 294/25

[58] Field of Search ..... 294/1.1, 3.6, 5.5, 294/25, 26, 19.1; 24/3.1, 3.2, 3.11, 3.12, 40; 63/2, 3; 223/1, 111

[56] References Cited

U.S. PATENT DOCUMENTS

| | | | |
|---|---|---|---|
| 2,896,890 | 4/1959 | Hlavac | 248/122 |
| 3,016,589 | 1/1962 | Collins | 24/3.2 |
| 3,242,540 | 3/1966 | Mitchell | 294/25 X |
| 3,276,087 | 10/1966 | Hanson | 294/3.6 |
| 4,650,141 | 3/1987 | Longo et al. | 248/118 |
| 4,734,973 | 4/1988 | Longo et al. | 29/428 |

FOREIGN PATENT DOCUMENTS

| | | | |
|---|---|---|---|
| 2129339 | 12/1972 | Germany | 294/3.6 |
| 1573067 | 8/1980 | United Kingdom | 294/3.6 |

*Primary Examiner*—Johnny D. Cherry
*Attorney, Agent, or Firm*—Sandra M. Kotin

[57] ABSTRACT

A hand-held portable device to assist in putting on jewelry of the type having a clasp at one end and a receiver at the other and being flexible therebetween. The device is in the form of a rigid elongated member with a stabilizing fin at one end and a clamp at the other. The method of using the device to put on a bracelet whereby the receiver is held in the clamp, the device grasped in the hand to receive the bracelet, the bracelet brought around the wrist and the clasp brought in proximity to the receiver and fastened. The device is thereafter released and removed. The similar method of using the device to put on a neckchain. The device can be used by most persons including those with limited dexterity.

7 Claims, 2 Drawing Sheets

DEVICE TO ASSIST IN PUTTING ON FLEXIBLE BRACELETS AND NECKLACES

FIELD OF THE INVENTION

The instant invention relates to a portable, hand held device to assist a person in putting on an article of jewelry such as a bracelet or neck chain.

BACKGROUND OF THE INVENTION

Most people find it difficult to put on articles of jewelry, especially a bracelet or wristwatch, and often a neck chain, without the assistance of another person. Someone with limited dexterity, a handicap, or extreme youth or age, will usually find this an impossible task to accomplish alone. Various devices have been developed to specifically assist in putting on bracelets, but some may prove more difficult to use than the performance of the task without the devices. None of these devices can be used to assist in putting on a necklace or neck chain.

Hlavac in U.S. Pat. No. 2,896,890 teaches a device which consists of a flexible metal strip mounted on a flat base that rests on a table or other support means. A fork is pivotally attached to the top of the strip. The user places one end of the bracelet in the fork. The bracelet is then laid over the base and the user places his/her wrist on the base, brings the free end of the bracelet around the wrist and connects the clasp. The bracelet is thereafter removed from the fork and the user removes his/her wrist from the base with the bracelet in place.

Using a similar concept, Longo et al. (U.S. Pat. Nos. 4,650,141 and 4,734,973) teaches a flat base with adhesive on the bottom to hold it to a table or wall. A support cut to receive a wrist is mounted perpendicular to the base. There is a clamp mounted on top of one side of the support to receive one end of a bracelet. The device is used in a manner similar to that of Hlavac. Both of these devices require the user to sit at the table or bend over it while putting on the bracelet.

In U.S. Pat. No. 3,016,589, Collins shows a flat strip of resilient material that is bent to partially encircle the wrist. One end of the strip is bent upward and formed into a bifurcated hook. The strip is clipped onto the wrist of the user and one end of a bracelet is secured in the hook while the other end is brought around the wrist and the clasp is fastened. The strip is thereafter removed. Another device to assist in putting on a bracelet consists of a long wire with a loop or circle at one end and a hook at the other. The loop is placed over the middle finger of the hand on which the bracelet is to be fastened. The wire is held against the palm of that hand by bending the middle finger and holding it against the wire. One end of the bracelet, the link, is held in the hook while the other end is brought around the wrist and fastened. The device is then removed. (Mitchell, U.S. Pat. No. 3,242,540) Both of these devices are flexible and require almost as much dexterity to use them as is required to put on a bracelet without assistance.

There is a need for a device to assist in putting on jewelry and watches that can be used by any person as well as one with limited dexterity or with a handicap. There is a need for such a device that is small, portable, easy to use, does not have to be anchored or stabilized on a table or wall, and one that can assist in putting on a necklace or neck chain as well as a piece of jewelry worn on the wrist.

BRIEF SUMMARY OF THE INVENTION

The present invention provides a portable, lightweight, stabilized, hand held device to assist a person in putting on jewelry. The device has a rigid support or strut that rests against the palm of the hand, a stabilizing fin to prevent wobbling or turning, and a clamp that securely holds one end of the bracelet or chain so that the end cannot slip out before the clasp is fastened.

It is an object of the present invention to provide a device to assist in putting on jewelry that can be used with ease by a person, young or old, with limited dexterity or with a handicap.

It is another object of the present invention that the device can be used with bracelets and wrist watches as well as necklaces and neck chains.

It is a further object of this invention to have a device that is inexpensive and easy to manufacture.

A still further object of the present invention is that the device hold the jewelry securely, but will not damage it in any way during use.

Another object of the present invention is to have a device that is easily held in the hand and does not have to be anchored to a table or wall.

Another object of the present invention is to have a stabilizing fin that fits into the palm of the hand and which can be held in place by any one, or more than one finger.

A further object of the present invention is to have a device that can be used by persons with hands of varying sizes and by children.

A still further object of the instant invention is to have a device that is portable, lightweight and small enough to fit into any jewelry case, purse or dresser tray.

Other features and advantages of the invention will be seen from the following description and drawings.

DETAILED DESCRIPTION OF THE INVENTION

Figure 1:
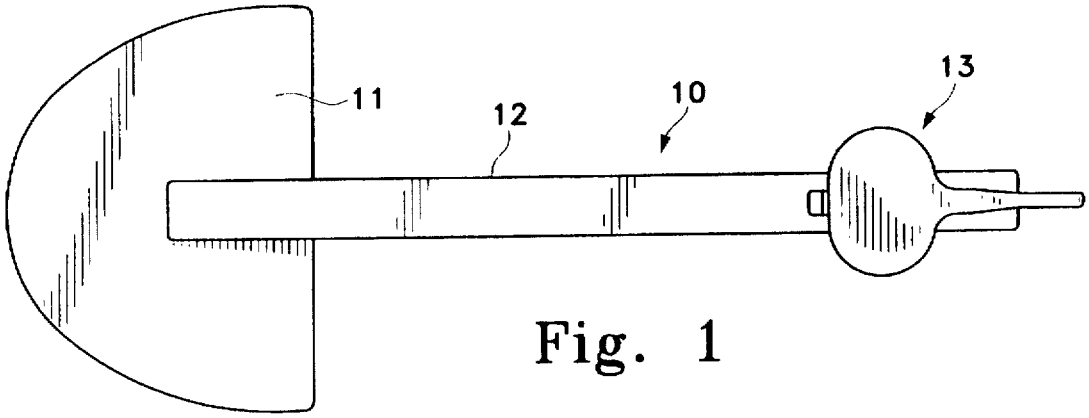
FIG. 1 is a top plan view of the device of the instant invention.
Figure 2:
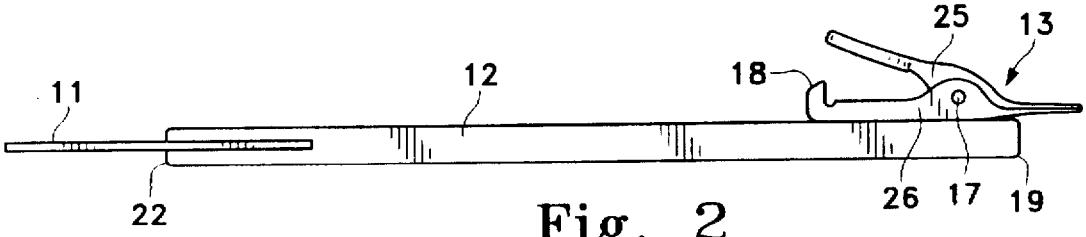
FIG. 2 is a side elevation of the device of FIG. 1.
Figure 3:
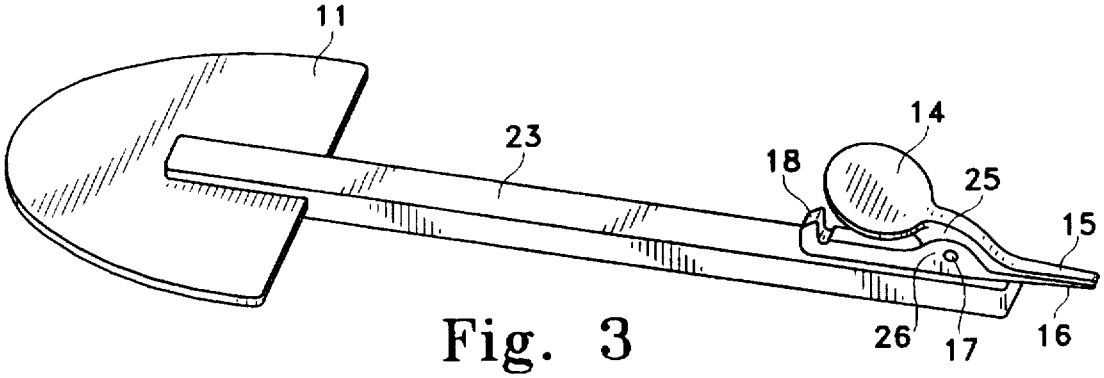
FIG. 3 is a perspective view of the device of FIG. 1.

The jewelry assist 10 is composed of three major parts, a strut 12, a stabilizing fin 11 and a clamp 13 as seen in FIGS. 1, 2 and 3. The strut 12 is narrow and long enough to be held in the palm of the hand when the clamp 13 is resting over the wrist area. An opitimal length is 11.4 cm (4.5 inches). The strut 12 can be made of any rigid substance such as wood, metal or a polymeric material.

The stabilizing fin 11 is rigid, flat and cut in a substantially semicircular pattern. It can be made of wood, stiff cardboard, metal or a polymeric material.

The stabilizing fin 11 is affixed at the distal end 22 of the strut 12. This can be accomplished by cutting a horizontal slit into the distal end 22 of the strut 12. The stabilizing fin 11 is inserted therein and fixedly held by any method known in the art. (FIGS. 2 and 3) The strut 12 and stabilizing fin 11 can also be constructed in a single unit.

The clamp 13 is affixed to the proximal end 19 of the strut 12 on its upper surface 23. This can be accomplished by using an adhesive, a staple or rivet, having the clamp set into polymeric material during the molding process or any other method known in the art. The clamp is made of a metal, but a plastic can be used. Copper is the preferred metal because it will not scratch or mar fine gold and silver jewelry.

Figure 4:
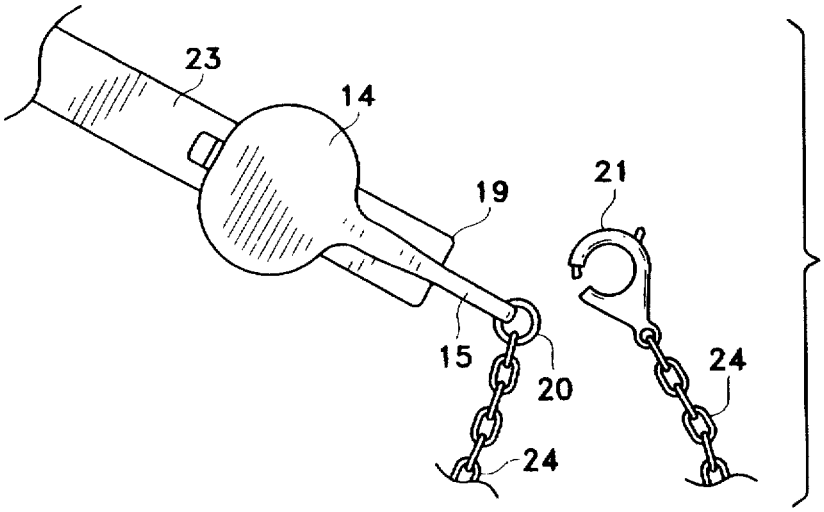
FIG. 4 is a top plan view of the front end of the device also showing how the attaching ring of a chain is held securely for fastening.

The clamp 13 has an upper jaw 15 and a lower jaw 16. Both jaws are flat and elongated at the proximal ends for grasping the attaching ring 20 of a chain 24. See FIG. 4. The upper jaw 15 has two opposed downward facing flanges 25 built into the mid-section and a flat enlarged finger rest or depressor 14 at the distal end. See FIG. 3. The depressor 14 is at least the size of a dime. This size is designed so that even a person with limited dexterity will have no difficulty maintaining the contact and pressing it down when using the device.

The lower jaw 16 has two opposed upward facing flanges 26 at the mid-section, with the flanges extending to the distal end where they are upturned to form a stop bracket 18 which the depressor 14 contacts during use. The mid-section flanges 25 of the upper jaw 15 rest within the mid-section flanges 26 of the lower jaw 16 and they are held in place by a pivot pin 17 as seen in FIG. 3. A coiled biasing spring, which is not illustrated, encircles the pivot pin 17 and biases the jaws together when the clamp 13 is closed.

Figure 5:
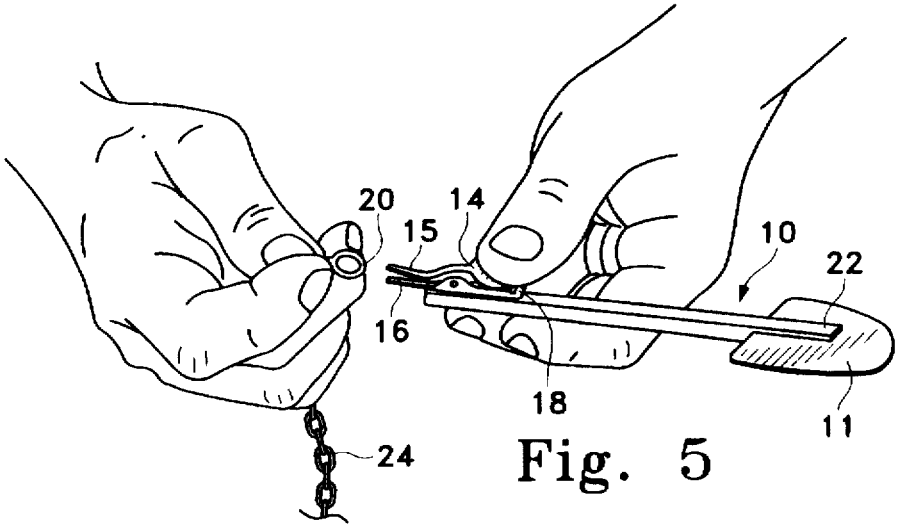
FIG. 5 is a close-up perspective view showing the attaching ring being inserted into the jaws of the clamp.

To use the jewelry assist 10 it is grasped in one hand and the depressor 14 is pressed down with the thumb, opening the jaws. The attaching ring 20 of the chain is brought toward the open jaws with the other hand, placed between the jaws, and the depressor 14 released. See FIG. 5. The attaching ring is thereafter held securely in the jaws of the clamp 13.

Figure 6:
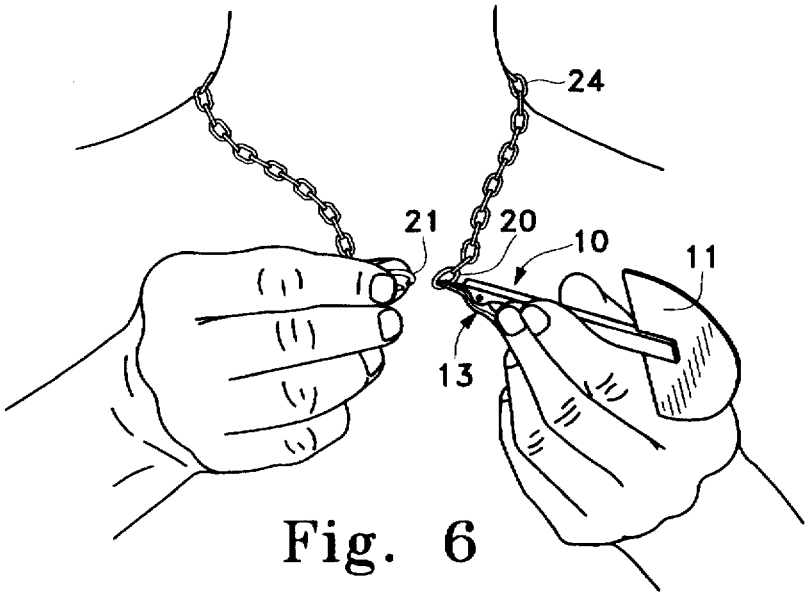
FIG. 6 is a front view of a person using the device to aid in putting on a neck chain.

If the chain is a necklace, the user places the chain around his/her neck, and, holding the jewelry assist 10 in one hand brings the open clasp 21 toward it with the other hand and fastens the clasp. This is illustrated in FIG. 6. The depressor 14 is thereafter pressed down to release the attaching link 20 from the jaws. This is done in front of the user. The chain can then be turned around so the clasp is in the back.

Figure 7:
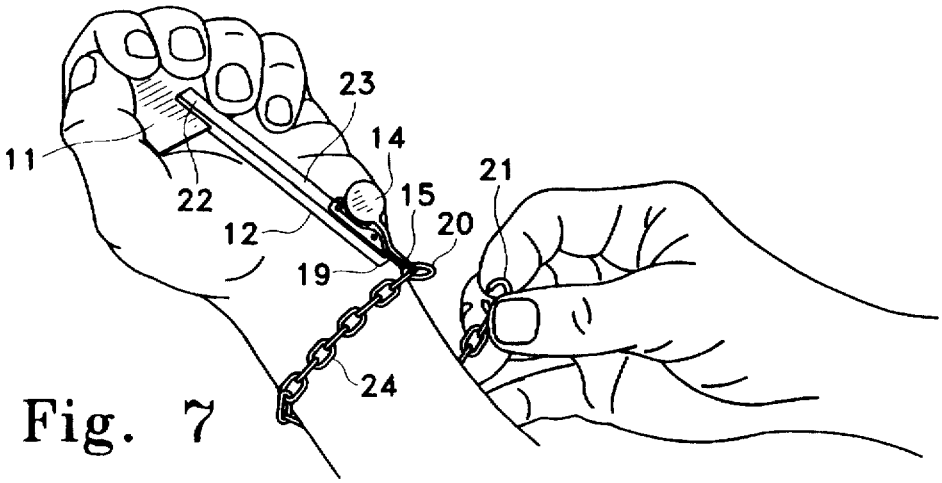
FIG. 7 is a perspective view showing how the device is held for putting on a bracelet, with the attaching ring being securely grasped in the clamp and the clasp being brought in for fastening the bracelet about the wrist.

If a bracelet (or other wrist jewelry) is to be affixed about the wrist, the user places the jewelry assist 10 (with the attaching link 20 held in the jaws as described above) in the palm of the hand on which the bracelet is to be fastened. The clamp 13 should be facing upward away from the palm of the hand. The fingers are bent over against the stabilizing fin 11, holding the device securely. When held in this manner, the clamp 13 lies over the wrist. The opposing end of the bracelet is brought around the wrist with the other hand, the clasp 21 opened and brought to the attaching link 20 and fastened. This is illustrated in FIG. 7. The depressor 14 is thereafter depressed, with the free hand, releasing the bracelet, and the jewelry assist 10 is removed.

The stabilizing fin 11 can be held securely in place by just one finger or more than one. This makes it possible for the device to be used by handicapped persons. The stabilizing fin 11 prevents the device from wobbling or turning during use.

The jewelry assist 10 can be used by adults, children and by those with limited dexterity. One general size can be used by most people, but it can be made in different sizes or the strut 12 may be made adjustable in length by any method known in the art.

The instant invention makes it very easy to put on any bracelet, wristwatch or other wrist chain. This task is often difficult to perform alone by most people, but is often impossible for the elderly, the very young, and anyone with arthritis or other handicap. Its use to assist in putting on a necklace can be a time-saver for the average person, but can also make this task possible for the elderly and handicapped who might otherwise not be able to accomplish it without assistance.

The device is small, light in weight, and takes up very little room. It can fit into any jewelry box or case, dresser tray, travel or makeup case, purse or pocket. The device is inexpensive and simple to manufacture.

While one embodiment of the present invention has been illustrated and described in detail, it is to be understood that this invention is not limited thereto and may be otherwise practiced within the scope of the following claims.

I claim:

1. A hand held device to assist in putting on jewelry of the type having a fastening means at one end and an attaching means at the other end and being flexible therebetween, said device comprising:

a strut member having a distal end, a proximal end, an upper surface and a lower surface;

stabilizing means fixedly attached to the distal end of said strut member for stabilizing the device in the hand of the user; and clamp means fixedly attached to the upper surface of the proximal end of said strut member for grasping the attaching means of the jewelry.

2. A hand held device to assist in putting on jewelry of the type having a fastening means at one end and an attaching means at the other end and being flexible therebetween, said device comprising:

a strut having a distal end, a proximal end, a upper surface and a lower surface;

a stabilizing fin fixedly attached to the distal end of said strut; and a clamp fixedly attached to the upper surface of the proximal end of said strut.

3. A hand held device to assist in putting on jewelry of the type having a fastening means at one end and an attaching means at the other end and being flexible therebetween, said device comprising:

a strut having a distal end, a proximal end, a upper surface and a lower surface;

a stabilizing fin fixedly attached to the distal end of said strut for stabilizing the device in the hand of the user, said stabilizing fin being rigid, flat, substantially semi-circular and lying in the horizontal plane of the strut; and a clamp fixedly attached to the upper surface of the proximal end of said strut for grasping the attaching means of the jewelry, said clamp having a depressor means, an upper jaw and a lower jaw, said jaws being elongate and flat.

4. A hand held device to assist in putting on jewelry as in claim 3 wherein the strut and stabilizing fin are of a singular unit construction.

5. A hand held device to assist in putting on jewelry as in claim 3 wherein the clamp is made of copper.

6. A method for using a hand held device to assist in putting on a bracelet of the type having a fastening means at one end and an attaching means at the other end and being flexible therebetween and said device comprising a strut having a distal end, a proximal end, a upper surface and a lower surface; a stabilizing fin fixedly attached to the distal end of said strut; and a clamp fixedly attached to the upper surface of the proximal end of said strut, said clamp having a depressor means, an upper jaw and a lower jaw, said method comprising:

depressing the depressor means such that the jaws open, bringing the attaching means into proximity of the jaws, releasing the depressor means so that the attaching means is securely held between the jaws;

placing the device in the palm of the hand to which the bracelet is to be fastened so that the stabilizing fin lies flat in the palm of the hand, the clamp is facing upward and lying above the wrist and the fingers are bending over and contacting the stabilizing fin to hold it in place;

bringing the bracelet around the wrist with the other hand, opening the fastening means, bringing the fastening means into proximity with the attaching means, fastening the fastening means to the attaching means; and depressing the depressor means, releasing the attaching means from the jaws of the clamp, and removing the device.

7. A method for using a hand held device to assist in putting on a necklace or neck chain of the type having a fastening means at one end and an attaching means at the other end and being flexible therebetween and said device comprising a strut having a distal end, a proximal end, a upper surface and a lower surface; a stabilizing fin fixedly attached to the distal end of said strut; and a clamp fixedly attached to the upper surface of the proximal end of said strut, said clamp having a depressor means, an upper jaw and a lower jaw, said method comprising:

depressing the depressor means such that the jaws open, bringing the attaching means into proximity of the jaws, releasing the depressor means so that the attaching means is securely held between the jaws;

holding the device in one hand, bringing the necklace around the neck such that the fastening means is brought in front of the user and held in the other hand, opening the fastening means, bringing the fastening means into proximity with the attaching means, fastening the fastening means to the attaching means; and depressing the depressor means, releasing the attaching means from the jaws of the clamp, and removing the device.

* * * * *